US010755514B2

(12) United States Patent
Kemmerling

(10) Patent No.: US 10,755,514 B2
(45) Date of Patent: Aug. 25, 2020

(54) DRUM STORAGE MODULE FOR RECEIVING NOTES OF VALUE

(71) Applicant: Wincor Nixdorf International GmbH, Paderborn (DE)

(72) Inventor: Thomas Kemmerling, Brilon-Madfeld (DE)

(73) Assignee: Wincor Nixdorf International GMBH, Paderborn (DE)

( * ) Notice: Subject to any disclaimer, the term of this patent is extended or adjusted under 35 U.S.C. 154(b) by 463 days.

(21) Appl. No.: 15/212,727

(22) Filed: Jul. 18, 2016

(65) Prior Publication Data

US 2017/0022022 A1 Jan. 26, 2017

(30) Foreign Application Priority Data

Jul. 20, 2015 (EP) ..... 15177447

(51) Int. Cl.
*G07D 11/235* (2019.01)
*B65H 43/08* (2006.01)
(Continued)

(52) U.S. Cl.
CPC ..... *G07D 11/235* (2019.01); *B65H 26/08* (2013.01); *B65H 29/006* (2013.01); *B65H 43/08* (2013.01); *G07D 11/13* (2019.01); *G07D 11/16* (2019.01); *G07D 11/23* (2019.01); *B65H 2301/4191* (2013.01); *B65H 2301/41912* (2013.01);
(Continued)

(58) Field of Classification Search
CPC ..... G07D 11/00; G07D 11/0003; G07D 11/0006; G07D 11/0009; G07D 11/0012; G07D 11/0015; G07D 11/0021; G07D 11/0024; G07D 11/0027; G07D 11/0084; G07D 11/0087; G07D 13/00; G07D 2207/00; G07D 2211/00; G07D 11/10; G07D 11/12; G07D 11/125; G07D 11/13; G07D 11/135; G07D 11/16; G07D 11/165; G07D 11/17; G07D 11/23; G07D 11/235; G07D 11/50; B65H 29/006; B65H 29/12; B65H 29/125; B65H 29/14; B65H 29/145; B65H 2301/4314; B65H 2701/1912
USPC ..... 194/206, 207; 209/534; 235/379; 242/528; 271/176, 216
See application file for complete search history.

(56) References Cited

U.S. PATENT DOCUMENTS 5,761,089 A 6/1998 McInerny
8,684,156 B1 * 4/2014 Chang ..... G07F 7/04 194/207
(Continued)

OTHER PUBLICATIONS

Communication dated Jan. 28, 2016.
European Search Report dated May 24, 2016.

*Primary Examiner* — Jeffrey A Shapiro
(74) *Attorney, Agent, or Firm* — Black, McCuskey, Souers & Arbaugh LPA

(57) ABSTRACT

A drum storage module (50, 60) for receiving notes of value (16) has a winding drum (14) onto which the notes of value (16) are windable so as to be received between at least two foil belts (18 to 24). Further, a sensor for determining the maximum filling level of notes of value in the drum storage module (50, 60) is provided and has a light source (32) and a light receiver (34) arranged such that the beam path (36) from the light source (32) to the light receiver (34) extends parallel to the longitudinal axis (38) of the winding drum (14).

11 Claims, 1 Drawing Sheet

(51) Int. Cl.

| | |
|---|---|
| ***G07D 11/23*** | (2019.01) |
| ***G07D 11/16*** | (2019.01) |
| ***G07D 11/13*** | (2019.01) |
| ***B65H 29/00*** | (2006.01) |
| ***B65H 26/08*** | (2006.01) |

(52) U.S. Cl.
CPC .. *B65H 2511/142* (2013.01); *B65H 2553/412* (2013.01); *B65H 2701/1912* (2013.01)

(56) References Cited

U.S. PATENT DOCUMENTS

| | | | | |
|---|---|---|---|---|
| 2003/0116400 | A1 | 6/2003 | Saltsov et al. | |
| 2005/0139448 | A1* | 6/2005 | Griese | G07D 3/14 194/346 |
| 2009/0294242 | A1* | 12/2009 | Yu | G07D 11/0018 194/206 |
| 2010/0163571 | A1 | 7/2010 | Mizoro | |
| 2012/0103754 | A1* | 5/2012 | Robinson | B65H 29/006 194/206 |
| 2014/0262678 | A1* | 9/2014 | Ohara | G07D 11/0084 194/206 |

* cited by examiner

DRUM STORAGE MODULE FOR RECEIVING NOTES OF VALUE

BACKGROUND

1. Field of the Invention

The invention relates to a drum storage module for receiving notes of value, which comprises a winding drum onto which the notes of value are windable so as to be received between at least two foil belts. Further, the drum storage module has a sensor, by means of which it can be determined when a maximum admissible filling level of notes of value in the drum storage module has been reached or left. This sensor comprises a light source and a light receiver for receiving the light beam emitted by the light source. Leaving the maximum admissible filling level means that, after the maximum admissible filling level had previously been reached, the maximum admissible filling level is again fallen below, in particular after a note of value or several notes of value have been removed.

2. Description of the Related Art

In FIG. 1 a side view and in FIG. 2 a front view of a drum storage module according to the prior art illustrated in a highly simplified manner is shown. The drum storage module 10 comprises a winding drum 14 which is rotatable by means of a motor 12 and on which the notes of value 16 are wound so as to be received between two times two foil belts 18 to 24. Further, the drum storage module 10 has a housing 26 on which a light source 32 and a light receiver 34 of a sensor unit for determining a maximum filling level of the drum storage module 10 are provided via rails 28, 30.

The light source 32 and the light receiver 34 are arranged such that the beam path 36 along which the light beam emitted by the light source 32 extends to the light receiver 34 is arranged orthogonally to the longitudinal axis 38 of the winding drum 14.

As illustrated in FIG. 1, the notes of value 16, when wound onto the winding drum 14, are often not arranged in a straight line but are wavy, in particular due to the only partial contact with the foil belts 18 to 24.

This causes the problem that a possibly already completely filled drum storage module 10, i.e. a drum storage module which has reached its maximum filling level, cannot be identified correctly since as a result of the foil belts 18 to 24, just in the area along which the beam path 36 extends, the note of value is bent inwards, i.e. in the direction of the longitudinal axis 38 of the winding drum 14 so that despite a reaching of the actually already maximum filling level the light beam between the light source 32 and the light receiver 34 is not interrupted so that the reaching of the maximum filling level cannot be detected reliably.

In addition, the drum storage module 10 according to the prior art has the disadvantage that by mounting the receiver 34 on the lid of the housing 26 via the rails 28, 30 there results a long tolerance chain which may result in inaccuracies during measuring. The repeatability of a filling level in a drum storage module 10 and the reproducibility of a filling level over several drum storage modules 10 have high variances as a result of the long tolerance chain and referencing of the individual parts.

It is the object of the invention to specify a drum storage module for receiving notes of value, in which the reaching of a maximum filling level can reliably be determined in an easy manner.

SUMMARY

According to the invention, the light source and the light receiver are arranged such that the beam path along which the light beam emitted by the light source extends to the light receiver is oriented parallel to the longitudinal axis of the winding drum. The winding drum may be cylindrical.

Within the scope of this application, longitudinal axis of the winding drum in particular means the rotational axis about which the winding drum rotates.

By arranging the beam path parallel to the longitudinal axis of the winding drum it is achieved that, independent of the shape of the notes of value, in particular also in the case of wavy notes of value, the beam path and thus the light beam emitted by the light source always is interrupted when reaching the maximum filling level. Thus the reaching of the maximum filling level can be determined reliably and safely by means of one sensor only. The parallel course of the beam path ensures that the beam path extends over the entire length of the winding drum so that also only little parts of the note of value that bend outwards already are arranged in the beam path and thus interrupt the light beam. On the other hand, the leaving of the maximum admissible filling level can be detected reliably. In this way, it is achieved that the drum storage module is filled again with further notes of value only when it has sufficient receiving capacity again.

The light source and the light receiver may be arranged such that the distance of the beam path to the longitudinal axis of the winding drum corresponds to the maximum admissible thickness, i.e. that one thickness of the winding drum and of the notes of value wound thereon, at which the maximum filling level is reached.

The distance between the light source and the light receiver may be longer than the length of the winding drum so that the beam path covers the entire length of the winding drum. Thus, independent of the position at which the winding drum reaches its maximum thickness, the beam path always is interrupted as soon as this position with the maximum thickness is arranged in the area of the beam path. The length is the dimension of the winding drum parallel to the longitudinal or rotational axis of the winding drum.

The light source and the light receiver may be arranged such that the beam path extends in a straight line. In particular, the beam path is designed such that the light beam emitted by the light source extends directly to the light receiver, i.e. that no deflection takes place by means of interposed other optical elements, such as deflecting prisms. Thus, a minimum tolerance chain is achieved, which enables an even more accurate detection of the reaching of the maximum filling level of notes of value in the drum storage module.

The light source may be an LED. Thus an easy, cost-efficient production is achieved.

The light source and the light receiver may form a light barrier, which, when interrupted, suggests the reaching of the maximum filling level.

The drum storage module may comprise a housing, and the light source and/or the light receiver may be mounted directly on the housing. In this way, it is achieved that no additional elements are interposed that would result in a tolerance chain that would make the positioning of the light source and the light receiver, respectively, less accurate and would thus also result in a less accurate detection of the sensor formed by the light source and the light receiver.

The light source and the light receiver may be arranged on opposite sides of the housing.

The housing may include a first recess for receiving the light source and/or a second recess for receiving the light receiver. In this way, the light source and/or the light receiver can easily be mounted on the housing so that they are positioned accurately.

The first recess and/or the second recess may be punched into the housing. In particular, the recesses may be punched into the corresponding walls of the housing together with the bearings for the winding drum so that the distance between the recesses and the central axis of the winding drum is defined exactly and thus an accurate measuring of the reaching of the maximum permissible thickness and thus of the maximum filling level is possible.

The light source and/or the light receiver can be mounted on a board. In particular, the light source and/or the light receiver can be mounted on a board of a control unit of the drum storage module. In this way, a particularly easy and cost-efficient production is achieved.

The drum storage module comprises a control unit for controlling the drum storage module. The control unit may be designed to generates and in particular to output data with information about the fact that the drum storage module has reached its admissible maximum filling level when the light beam extending from the light source to the light receiver along the beam path has been interrupted. Dependent on these data, in particular the filling of the drum storage module with further notes of value can be stopped and/or a message can be output that the drum storage module is completely filled.

The control unit may generate data with information about the fact that the drum storage module has reached its maximum permissible filling level whenever the light beam is continuously interrupted for at least a predetermined fraction of a winding drum rotation.

Fraction of a winding drum rotation in particular means a predetermined rotational angle. Here, a fraction of a winding drum rotation can also correspond to exactly one winding drum rotation or can even be greater than one winding drum rotation.

The control unit may generate the data whenever the light beam is interrupted for at least an eighth of a winding drum rotation. As a result, it is achieved that the reaching of the maximum filling level can be inferred therefrom with reliability.

The drum storage module may comprise a control unit for controlling the drum storage module. The control unit may be designed such that it generates and in particular outputs data with information about the fact that the drum storage module has left its admissible maximum filling level when the light beam extending from the light source to the light receiver along the beam path is no longer interrupted. Dependent on these data, a filling of the drum storage module with further notes of value can take place again.

The control unit may generate the data with the information about the fact that the drum storage module has left its maximum admissible filling level whenever the light beam is continuously not interrupted for at least a predetermined fraction of a winding drum rotation.

The control unit may generate the data that the maximum filling level has been left whenever the light beam is interrupted for at least one winding drum rotation. In this way, it is achieved that it can be inferred therefrom with reliability that the maximum filling level has been left.

The drum storage module may have a motor for rotating the winding drum. The motor may be a stepper motor, a direct current motor (DC motor) with clock generator or a brushless direct current motor (BLDC motor) with clock generator. Via the number of steps or clocks of the motor, the respective rotational angle of the winding drum can be determined easily so that the control unit can determine by means of a corresponding comparison of the duration of the interruption or non-interruption of the light beam and thus the winding drum rotation covered during this time, i.e. the rotated rotational angle at this point in time, whether the light beam had been interrupted long enough to be able to reliably infer that the maximum filling level has been reached or left.

A sensor for determining the rotational position of the motor and/or of the winding drum also can be provided. In particular, an incremental shaft encoder can be used.

Further features and advantages of the invention result from the following description which explains the invention in more detail on the basis of embodiments in connection with the enclosed Figures.

DETAILED DESCRIPTION

Figure 1:
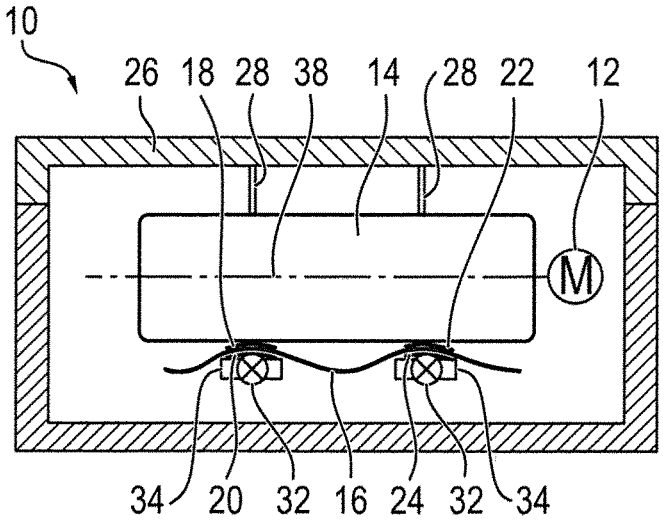
FIG. 1 Prior Art
FIG. 1 shows a side view of a schematic, highly simplified illustration of a drum storage module according to the prior art.
Figure 2:
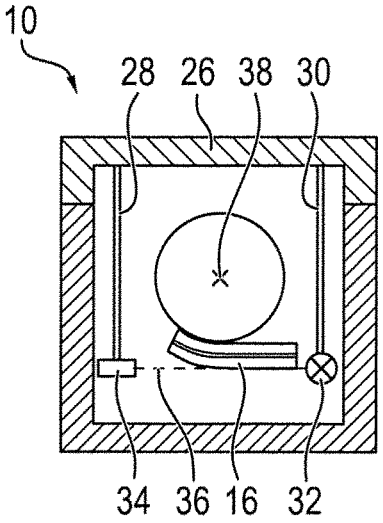
FIG. 2 Prior Art
FIG. 2 shows a front view of the drum storage module according to FIG. 1.
Figure 3:
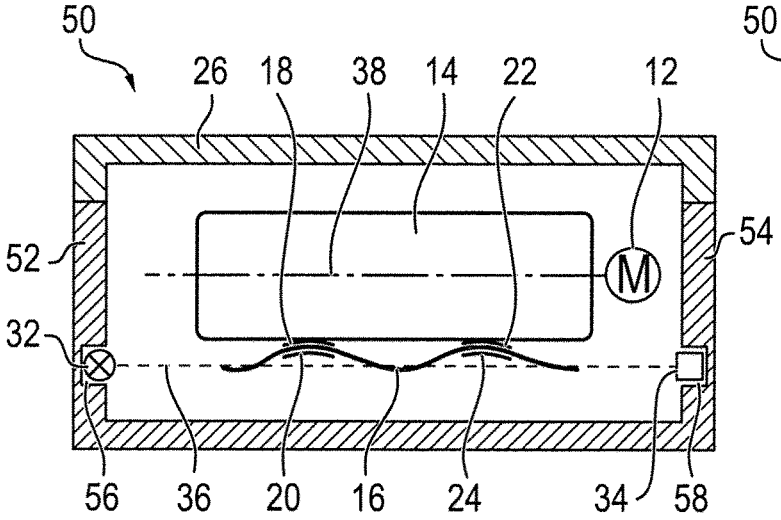
FIG. 3 shows a side view of a highly simplified drum storage module and a first embodiment of the invention.
Figure 4:
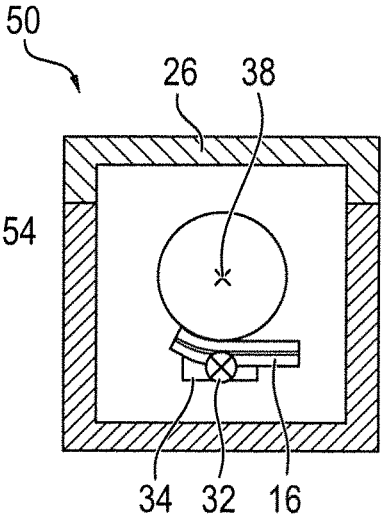
FIG. 4 shows a front view of the drum storage module according to FIG. 3.

In FIGS. 3 and 4, a schematic, highly simplified illustration of a drum storage module 50 according to a first embodiment is shown, wherein FIG. 3 shows a side view and Figure shows a front view. Elements having the same function or the same structure as in the embodiment of the prior art according to FIGS. 1 and 2 are identified with the same reference signs.

The drum storage module 50 comprises a housing 26 within which a winding drum 14 is arranged, which can be rotated about its longitudinal axis 38 via a motor 12. By means of the rotation of the winding drum 14 notes of value 16 are received between foil belts 18 to 24 and wound onto the winding drum 14.

Recesses 56, 58 are provided on the side walls 52, 54 of the housing 26. A light source 32 and a light receiver 34 of a sensor unit are provided in the recesses 56 and 58 respectively for determining the reaching of the maximum admissible filling level of notes of value in the drum storage module 50. The light source 32 preferably is an LED that emits a light beam along a beam path 36 to the light receiver 34, which detects this light beam as long as no note of value is present in the beam path 36, i.e. the light beam is not interrupted. Based on the interruption of the light beam a control unit can infer the reaching of the maximum filling level of the drum storage module 10 under previously determined criteria. In particular, a message is output that the drum storage module is filled completely whenever the light beam is interrupted during the rotation of the winding drum 14 for at least a predetermined fraction of a winding drum rotation, in particular an eighth of a winding drum rotation.

The light source 32 and the light receiver 34 are arranged such that the beam path 36 and thus also the light beam emitted by the light source 32 extend parallel to the longitudinal axis 38 of the winding drum 14. In this way, as shown by the comparison with the situation illustrated in FIG. 1, it is achieved that also in the case of wavy notes of value 16 the beam path 36 is nevertheless always reliably interrupted provided that the maximum filling level of the drum storage module 10 is reached. Thus, independent of the shape of the notes of value 16, the reaching of the maximum permissible filling level can be detected reliably.

As shown in FIGS. 3 and 4, the first and second recesses 56, 58 are centered on the beam path and thereby parallel to the longitudinal axis 38 of the winding drum 14. The recesses 56, 58 in which the light source 32 and the light receiver 34 are arranged, respectively, are punched into the side walls 52, 54 together with the bearings for the winding drum 14 so that the distance between the central axis 38 and the light receiver 34 and the light source 32 and thus the beam path 36 is defined very accurately. This distance in particular corresponds to the maximum permissible thickness that the winding drum 14 may reach by winding up the notes of value and that represents the maximum admissible filling level. In addition, a minimum possible tolerance is achieved as a result of the direct mounting on the walls 52, 54 of the housing 26 that itself encloses the winding drum 14. In particular, longer tolerance chains caused by interposing additional mounting elements are avoided.

Figure 5:
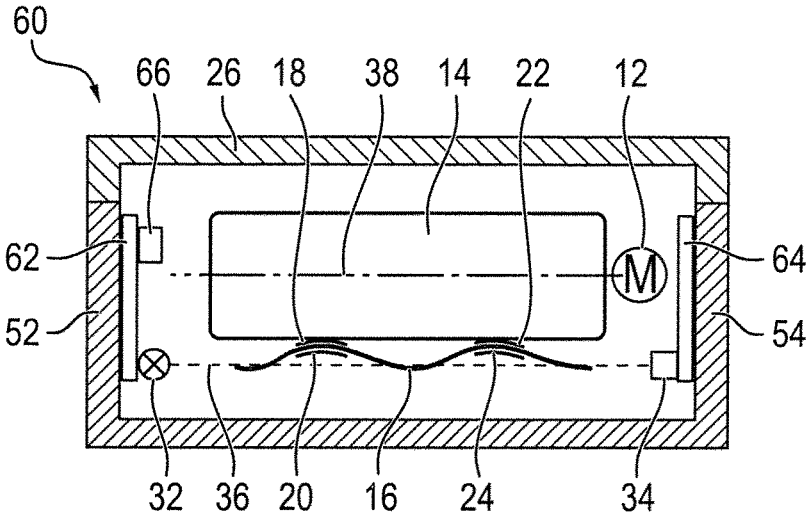
FIG. 5 shows a schematic, highly simplified illustration of a drum storage module according to a second embodiment of the invention.

In FIG. 5, a schematic, highly simplified illustration of a drum storage module 60 according to a second embodiment is provided. Here, the light source 32 and the light receiver 34 are not mounted directly on the walls 52, 54 of the housing, but rather are on a board 62, 64 that then in turn is mounted on the walls 52, 54. As a result, a particularly easy production is achieved, and a separate cabling can be dispensed with.

The board 62 is in particular a board on which also the control unit 66 for controlling the drum storage module 60 is arranged. Thus, additional component parts can be dispensed with.

By arranging the beam path 36 parallel to the longitudinal axis 38 along the entire winding drum 14 it is achieved that only one single sensor unit composed of a light source 32 and a light receiver 34 is necessary. The sensor unit can be arranged at many possible positions within the drum storage module. Thus, the naturally only limited available space within the drum storage module 60 is used effectively.

Further, in this way, other optical sensor units that are oriented vertically with respect to the central axis 38 of the drum storage module 14 are not impaired or affected.

In addition, by means of the smallest possible tolerance chain different extensions of the drum storage module can reliably be reproduced and repeatably identified.

A further advantage of arranging the light source on the side walls 52, 54 is that in this way, the light source 32 and the light receiver 34 are contaminated substantially less by dust and contaminants falling down from the notes of value and thus a maintenance is required only rarely and the reliability is increased.

LIST OF REFERENCE SIGNS

10, 50, 60 drum storage module
12 motor
14 winding drum
16 note of value
18 to 26 housing
28, 30 rail
32 light source
34 light receiver
36 beam path
38 longitudinal axis
52, 54 side wall
56, 58 recess
62, 64 board
66 control unit

What is claimed is:

1. A drum storage module for receiving notes of value, comprising:

a winding drum having a longitudinal axis and on which the notes of value are windable so as to be received between at least two foil belts;

a first sensor comprising a light source and a light receiver, wherein the light source and the light receiver are arranged so that a beam path from the light source to the light receiver extends parallel to the longitudinal axis of the winding drum;

wherein the drum storage module comprises a housing enclosing the winding drum;

wherein the light source and the light receiver are mounted directly on the housing enclosing the winding drum; and wherein a first recess in the housing enclosing the winding drum receives the light source and a second recess in the housing enclosing the winding drum receives the light receiver, the first and second recesses centered on the beam path and thereby parallel to the longitudinal axis of the winding drum.

2. The drum storage module of claim 1, wherein the light source and the light receiver are arranged so that a distance between the beam path and the longitudinal axis of the winding drum corresponds to a maximum permissible thickness of the winding drum and the notes of value wound thereon.

3. The drum storage module of claim 1, characterized in that the distance between the light source and the light receiver is longer than the length of the winding drum.

4. The drum storage module of claim 1, wherein the light source and the light receiver are arranged such that the beam path extends in a straight line.

5. The drum storage module of claim 1, wherein the light source comprises an LED.

6. The drum storage module of claim 1, wherein the recesses are punched into the housing.

7. The drum storage module of claim 1, wherein the drum storage module comprises a control unit that generates data with information that the drum storage module has reached its maximum permissible filling level when the light beam extending from the light source to the light receiver along the beam path has been interrupted.

8. The drum storage module of claim 7, wherein the control unit generates the data whenever the light beam has been interrupted for at least a predetermined fraction of a winding drum rotation.

9. The drum storage module of claim 8, wherein the control unit generates the data whenever the light beam has been interrupted for at least an eighth of a winding drum rotation.

10. The drum storage module of claim 1, wherein the drum storage module comprises a control unit that generates data with information indicating that the drum storage module has again left its maximum permissible filling level when the light beam extending from the light source to the light receiver along the beam path is no longer interrupted.

11. The drum storage module of claim 10, wherein the control unit generates the data whenever the light beam has continuously not been interrupted for at least a predetermined fraction of a winding drum rotation, exactly one winding drum rotation or at least a predetermined multiple of a winding drum rotation.

* * * * *